United States Patent [19]

McCallum et al.

[11] Patent Number: 4,662,300

[45] Date of Patent: May 5, 1987

[54] OFFSHORE LOAD-HANDLING SYSTEM

[75] Inventors: Robert McCallum, Hamilton; David Mitchell, Glasgow, both of United Kingdom

[73] Assignee: Caley Hydraulics Limited, Glasgow, United Kingdom

[21] Appl. No.: 767,286

[22] PCT Filed: Dec. 3, 1984

[86] PCT No.: PCT/GB84/00415

§ 371 Date: Aug. 20, 1985

§ 102(e) Date: Aug. 20, 1985

[87] PCT Pub. No.: WO85/02381

PCT Pub. Date: Jun. 6, 1985

[30] Foreign Application Priority Data

Dec. 3, 1983 [GB] United Kingdom ..... 8332335

[51] Int. Cl.[4] ..... B63B 35/40

[52] U.S. Cl. ..... 114/259; 114/312; 414/626; 294/119.4; 212/147

[58] Field of Search ..... 114/259, 268, 312, 370, 114/368, 377, 378; 212/148, 259, 242, 146, 147; 414/626; 294/119.4

[56] References Cited

U.S. PATENT DOCUMENTS

| | | | |
|---|---|---|---|
| 3,401,804 | 9/1968 | Link | 212/147 |
| 3,807,334 | 4/1974 | Egeberg | 114/268 |
| 3,955,522 | 5/1976 | Gaudiano et al. | 114/259 |
| 4,531,647 | 7/1985 | Higuchi et al. | 212/147 |

FOREIGN PATENT DOCUMENTS 2750809 4/1979 Fed. Rep. of Germany .

*Primary Examiner*—Sherman D. Basinger
*Assistant Examiner*—Paul E. Salmon
*Attorney, Agent, or Firm*—Dickstein, Shapiro & Morin

[57] ABSTRACT

An A-frame has a winch head swingable from a cross-member and between its two arms. A docking member comprises an upper frame depending, by means of hydraulic rams, from the winch head and a lower frame swingable from the upper frame about an axis perpendicular to the axis about which the winch head can swing from the cross-member. Guides for a load-carrying line are provided on the frames.

3 Claims, 4 Drawing Figures

OFFSHORE LOAD-HANDLING SYSTEM

This invention relates to an offshoreload-handling system and is primarily concerned with a ship-board handling system for a submersible.

In a known ship-board load-handling system for a submersible there is provided a hydraulically operated A-frame on which is swingably hung a winch head carrying a winch and from which head is suspended by hydraulic rams, a frame interconnected with the head by a telescopic leg for linear guidance of the frame relative to the head. The frame carries a latch and one or more funnels for receiving probes on the submersible and a load-carrying line extends from the winch and through the frame.

Although the swinging of the head and the frame relative to the A-frame about a transverse axis accommodates some of the complex movement between a motor ship and a submersible it does not accommodate rolling movement. This has proved to be a problem in docking on recovery of the submersible from the water and in inducing damaging forces on the A-frame and on the submersible.

It is an object of the invention to obviate or mitigate this problem.

According to the invention, there is provided an off-shore load-handling system comprising a support for moving a load between two positions substantially at the same level, and a mechanism mounted on the support for raising and lowering a load, the mechanism including a hydraulically-operable docking and load-carrying member mounted on the support with provision for swinging movement of the docking member relative to the support about two mutually perpendicular axes, means for damping such swinging movement, and a load-carrying line, the docking member having a latch for securing a load thereto, means for locating the load thereon and means for guiding the load-carrying line.

Embodiments of the invention will now be described, by way of example, with reference to the accompanying drawings, in which.

Figure 1:
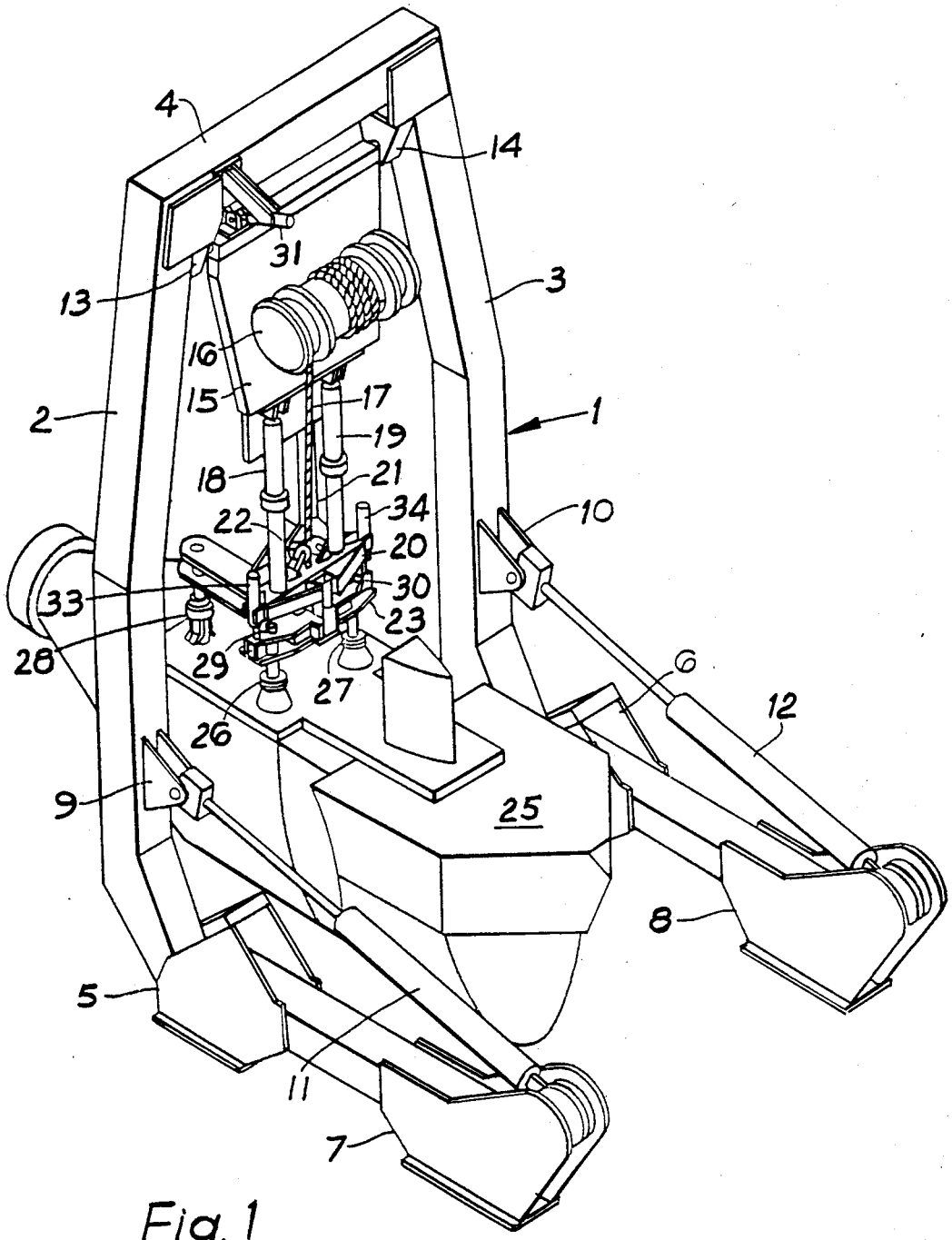
FIG. 1 is a perspective view of a handling system, for a submersible, as mounted at the stern of a mother ship.
Figure 2:
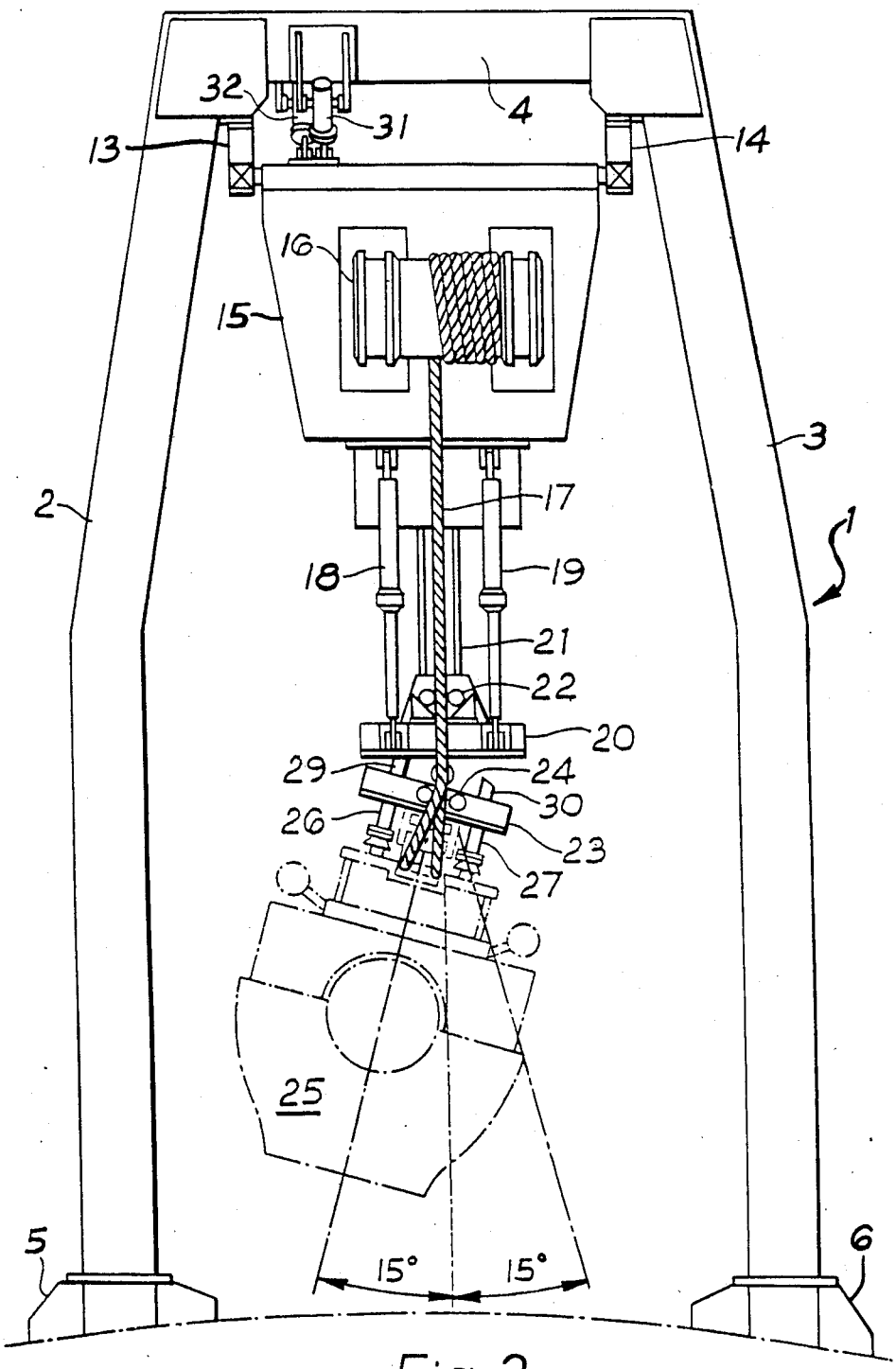
FIG. 2 is an elevation of the handling system.

In FIGS. 1 and 2 the handling system comprises an A-frame 1 having side arms 2 and 3 and a cross member 4 interconnecting the arms 2 and 3 at outer ends thereof. The inner ends of the arms 2 and 3 are pivoted in mountings 5 and 6 on the ship's deck at the stern thereof. Further forward on the ship's deck are mountings 7 and 8 between which and brackets 9 and 10 on the arms 2 and 3 are articulated hydraulic rams 11 and 12.

Inboard of the arms 2 and 3 and depending from the cross member 4 are brackets 13 and 14 between which is swingably suspended on a winch head 15 within which is mounted a winch 16 about which is rove a load-carrying line 17. The line 17 extends downwards from the winch 16 between two hydraulic rams 18 and 19 interconnecting the head 15 and an upper frame 20.

The head 15 and the frame 20 are also interconnected by a telescopic leg 21 aft of the line 17 and which serves to guide the movement of the frame 20 linearly relative to the head 15. The frame 20 also has an upper fairlead 22 for the line 17 and comprising at least two and preferably four rollers.

A lower frame 23 is swingably suspended from the frame 20 about an axis perpendicular to the swinging axis of the head 15. The frame 23 carries a lower fairlead 24 comprising at least two and preferably four rollers, for the line 17. The frame 23 also carries a latch (not shown) for an attachment point on a submersible 25 for the line 17. Furthermore, the frame 23 carries docking funnels 26, 27 and 28 for receiving probes on the submersible. Above the funnels 26 and 27 are stops 29 and 30 to limit the amount of swing of the frame 23 relative to the frame 20.

It should be noted that the frame 23 and thus the submersible 25 can swing about a transverse axis through the brackets 13 and 14 and a longitudinal axis relative to the frame 20. Hydraulically operable selectively damping rams 31, 32, 33 and 34 are provided to control both swinging movements.

When launching the submersible 25 it is moved out of its hangar on the deck to a position under the A-frame 1 in its boomed-in condition with the rams 11 and 12 retracted. The damping facility of the rams 31, 32, 33 and 34 is engaged. The line 17 is paid out and attached to the submersible 25. The winch 16 is set to light auto-tension. The rams 18 and 19 are extended and the funnels 26, 27 and 28 are engaged with the probes on the submersible 25 and the latch is engaged. The submersible 25 is now securely attached and properly located relative to the frame 23.

The submersible 25 is now attached to a tow rope from a winch on the ship's deck. The rams 18 and 19 are now retracted and the submersible 25 is lifted with the frame 23 clear of the deck. The A-frame 1 is boomed-out by extending the rams 11 and 12 so that the submersible 25 clears the stern of the ship. The rams 18 and 19 are again extended. The weight of the submersible 25 is now taken on the line 17 by operating the winch 16. This slightly retracts the rams 18 and 19 and the latch is disengaged. At this point the damping facility of the rams, 31, 32, 33 and 34 is also disengaged so that the submersible can swing freely. The submersible 25 is now lowered into the water using the winch 16 only and the line 17 is disengaged so that the submersible 25 is left only attached by the tow rope which is disengaged after final checks have been carried out prior to diving. The line 17 is now paid in by the winch 16 and the damping facility of the rams 31 and 32 is engaged.

When recovering the submersible 25 the tow rope is engaged therewith and the submersible is towed to a position below the boomed-out A-frame 1. The line 17 is then attached to the submersible 25 and the damping facility of the rams 31, 32, 33 and 34 is disengaged. The submersible 25 is hoisted out of the water using the winch 16, the angulation of the line 17 causing the lower frame 23 to be aligned with the submersible whereupon its probes are engaged in the funnels 26, 27 and 28 and the latch is engaged. The weight of the submersible is now taken partially on the rams 18 and 19 which are extended and the damping facility of the rams 31, 32, 33 and 34 is engaged. The rams 18 and 19 are now retracted to lift the submersible 25 further, remove the strain on the line 17 and prove the latch. The A-frame 1 is now boomed-in and the submersible 25 is lowered to the deck by extending the rams 18 and 19. The latch is then disengaged, the rams 18 and 19 are retracted, the line 17 is disengaged, the tow rope is disengaged and the submersible 25 is moved back into its hangar.

In some instances the selective damping facility may only be provided on the rams 33 and 34, the rams 31 and 32 always being in the damping mode.

Figure 3:
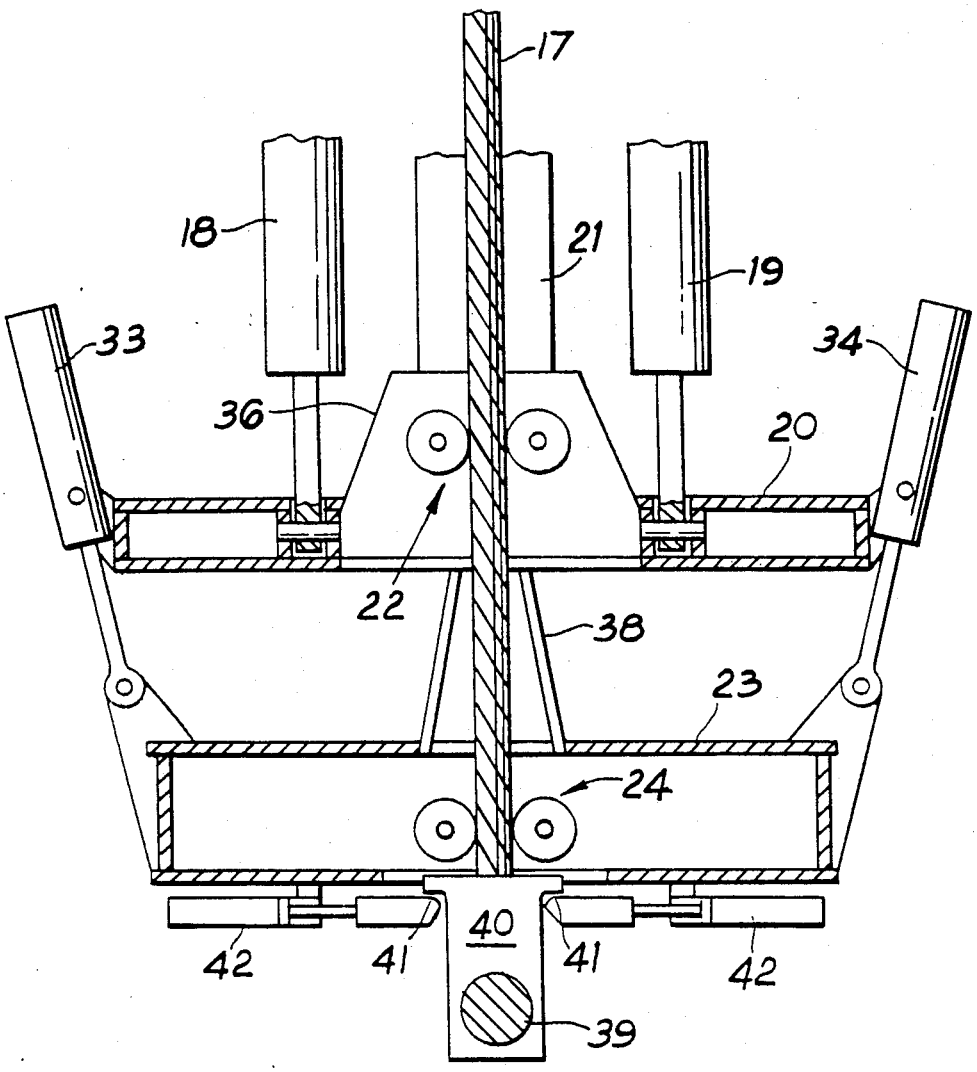
FIG. 3 is a section in a vertical plane lying transversely of the mother ship through a load-carrying line of a modified part of the handling system shown in FIGS. 1 and 2.
Figure 4:
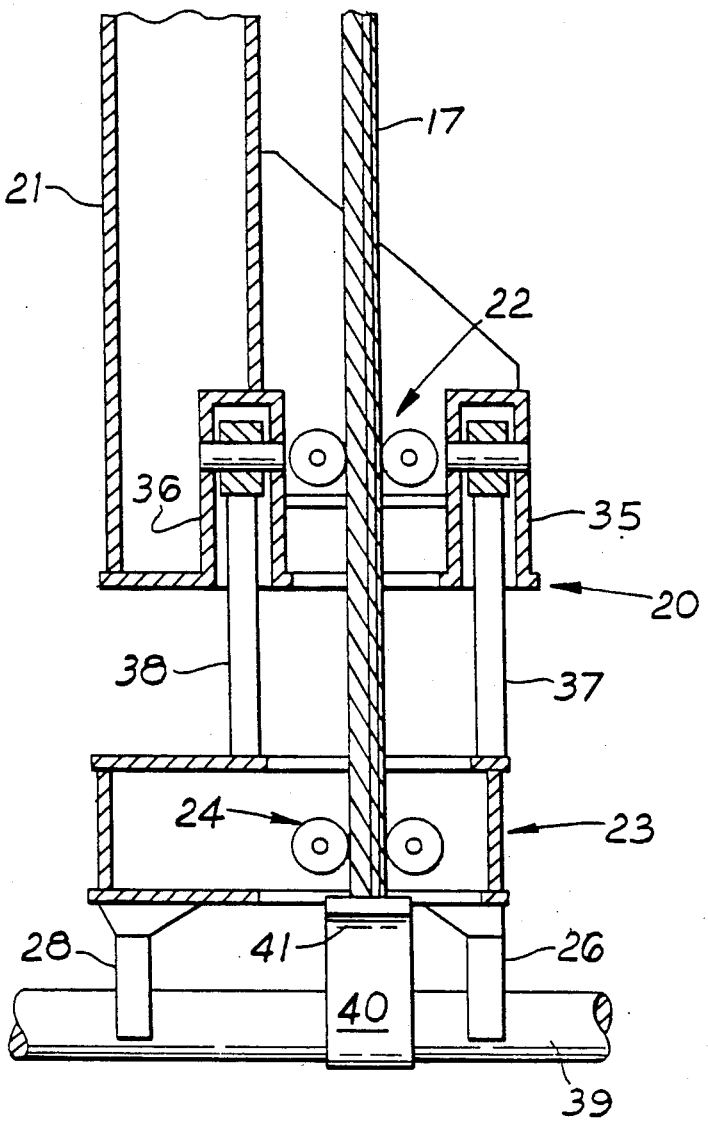
FIG. 4 is the same as FIG. 3 except that the vertical plane of the section lies longitudinally of the mother ship.

In FIGS. 3 and 4 is shown a modified assembly of upper and lower frames 20 and 23. The upper frame 20 includes fore and aft inverted pockets 35 and 36 within which elongate hangers 37 and 38 have their upper ends pivoted at the same level as the upper fairlead 22 and so improve the alignment of the lower frame 23 with the submersible. The hangers 37 and 38 upstand from the lower frame 23.

Also shown in FIGS. 3 and 4 is a strong back 39 of a submersible, on which strong back 39 is a tubular attachment 40 having shoulders 41 for cooperation with hydraulically-operated latches 42 on the bottom of the lower frame 23. On the lower end of the line 17 is a probe (not shown) which can be inserted into the attachment 40 for connecting the line 17 with the submersible. The lower fairlead 24 can be raised in guides (not shown) in the lower frame 23 by virtue of the line 17 being paid in sufficiently to introduce the attachment 40 to the lower frame 23. The raising of the fairlead 24 to an upper limit operates the latches 42 to attach the submersible to the lower frame 23.

The lower fairlead 24 in either embodiment may be replaced by a guide throat.

In a more sophisticated system the frame 23 may be replaced by a gimbal permitting swinging movement about longitudinal and transverse axes. In this case less damping at the gimbal than at the winch head 15 would be provided. Furthermore, instead of the winch 16 there could be provided a pulley on the head 15 with a deck-mounted winch. Alternatively, the A-frame 1 may be replaced by a crane, e.g. one with a top carriage movable along a horizontal boom, provided that provision is made for swinging about longitudinal and transverse axes. The invention may also be used to handle loads other than submersibles and may include more than one load-carrying line.

We claim:

1. An offshore load-handling system comprising:

a hydraulically-operated A-frame having side arms and a cross-member interconnecting the arms at corresponding ends thereof;

the side arms being mounted at their inner ends on a deck for pivotal movement relative to the deck about a first horizontal axis;

a head suspended under the cross-member for pivotal movement relative to the A-frame about a second horizontal axis parallel to the first horizontal axis;

an assembly depending from the head via hydraulic ram means for lowering and raising a second frame from and towards the head;

first formations on the underside of the assembly for locating and latching with second formations on a load in order to releasably secure the load without the possibility of its slewing relative to the assembly and a load-carrying line;

the assembly including the second frame connected directly to the hydraulic ram means, and a third frame suspended under the second frame for pivotal movement relative to the second frame about a third normally horizontal axis transverse to the first and second axes and under the second axis;

first damping means for damping the pivotal movement of the head relative to the A-frame about the second axis;

second damping means for damping the pivotal movement of the third frame relative to the second frame about the third axis;

at least the second damping means having a selective disengagement facility; and guiding means on the second and third frame for closely guiding the load-carrying line so that a load on the line causes the third frame to become aligned with the load.

2. A system according to claim 1, wherein the third axis is no higher than the guiding means on the second frame.

3. A system according to claim 2, wherein the third axis is at the same level as the guiding means on the second frame.

* * * * *